United States Patent [19]

DaVia

[11] 4,191,379

[45] Mar. 4, 1980

[54] BOARD GAME

[76] Inventor: Louis DaVia, 16235 ½, Paramount, Calif. 90723

[21] Appl. No.: 807,224

[22] Filed: Jun. 16, 1977

[51] Int. Cl.[2] ..... A63F 3/00

[52] U.S. Cl. ..... 273/258

[58] Field of Search ..... 273/258, 242, 287–259, 273/242, 236, 243, 244, 246, 248, 249, 250, 251, 252, 253, 254, 255, 256, 257, 258; D21/14, 15, 24, 32, 33, 34

[56] References Cited

U.S. PATENT DOCUMENTS

| | | | |
|---|---|---|---|
| 677,782 | 7/1901 | Lane | 273/258 |
| 715,474 | 12/1902 | Gaylor | 273/248 |
| 809,502 | 1/1906 | Hale | 273/258 X |
| 1,095,934 | 5/1914 | Seed | 273/249 |
| 1,524,740 | 2/1925 | Lorenz | 273/251 |
| 1,554,022 | 9/1925 | Nelson | 273/263 |
| 1,780,038 | 10/1930 | Parker | 273/258 |
| 3,460,834 | 8/1969 | Nickel | 273/264 |
| 3,730,527 | 5/1973 | Nelson | 273/258 |
| 4,083,564 | 4/1978 | Matsumoto | 273/260 |

FOREIGN PATENT DOCUMENTS

| | | | |
|---|---|---|---|
| 20317 | 9/1907 | United Kingdom | 273/258 |

*Primary Examiner*—Richard C. Pinkham
*Assistant Examiner*—Scott L. Brown
*Attorney, Agent, or Firm*—Fulwider, Patton, Rieber, Lee & Utecht

[57] ABSTRACT

A board game apparatus utilizes a playing board upon which a multiplicity of playing piece positions are delineated in interconnected fashion to form a number of alternative paths of playing piece movement. A prescribed number of playing pieces are provided for each player, and each playing piece has a particular value number of space movements associated therewith. The players in turn designate a particular one of their pieces for movement, which is then moved the exact value number of playing piece positions associated with that piece. If confronted with another playing piece blocking the path of movement, the selected piece is halted and the confronting piece continues movement along the path a number of player positions equal to the balance of the value number of the selected piece over the number of player positions that the selected piece had already been moved. The pieces may thereby be moved to exert "pressure" on other playing pieces to move those other playing pieces a distance proportional to the unused portion of the move of the pressure piece initiating movement.

7 Claims, 5 Drawing Figures

FIG. 1
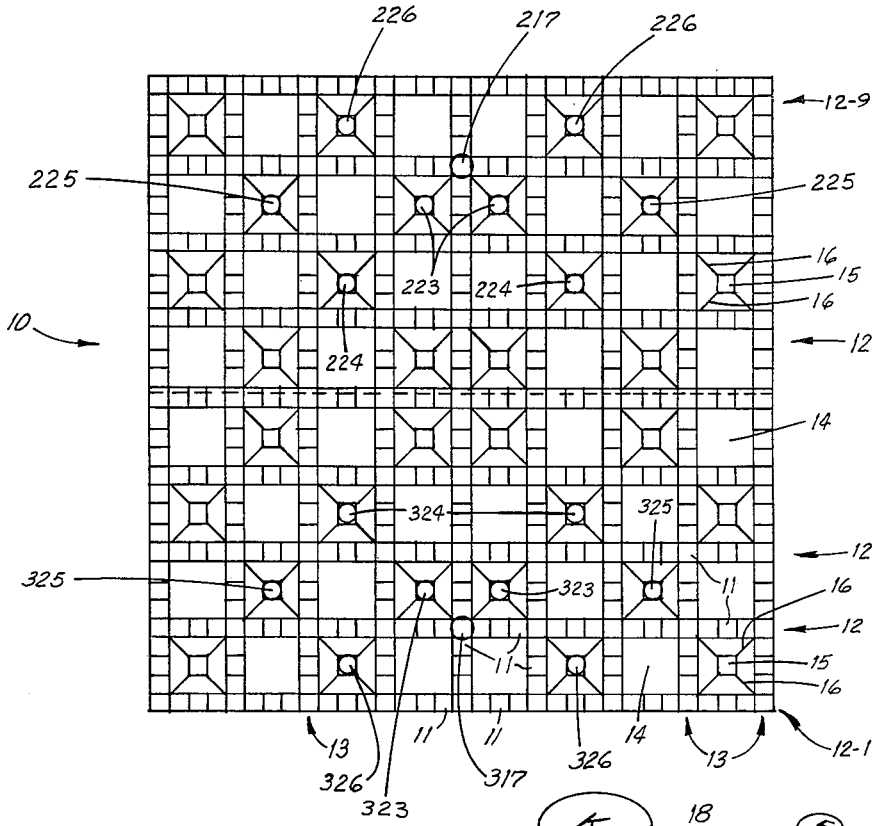
FIG. 2
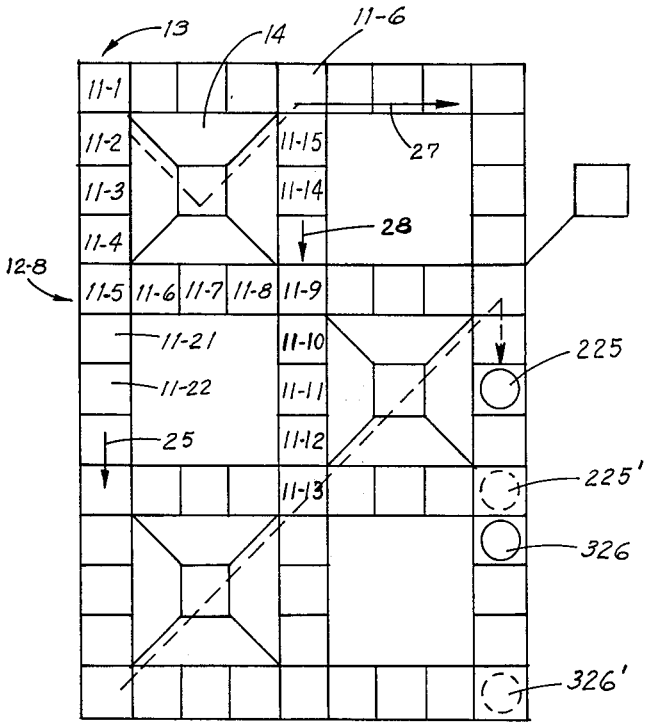
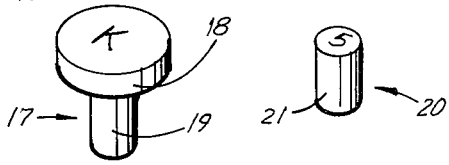
FIG. 4
FIG. 5
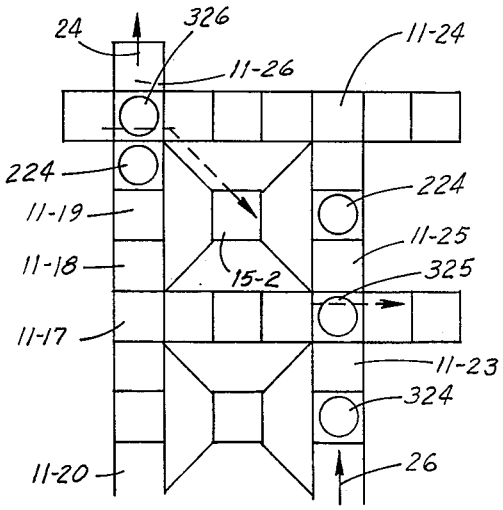
FIG. 3

BOARD GAME

FIELD OF THE INVENTION

The present invention relates to board games in which playing pieces are moved in turn by opposing players in a contest having a particular final position of one or more playing pieces as an objective.

BACKGROUND OF THE INVENTION

Numerous board games have been invented for amusement purposes employing different techniques of playing piece manipulation. The game of checkers matches two opponents beginning with an initial array of an equivalent number of playing pieces aligned in staggered relationship on ajoining squares of a common color on a checkerboard. The checker pieces are moved diagonally forward one space at a time with the objective of reaching the opponent's side of the board. When confronted with an opposing playing piece, a checker can be used to jump diagonally over that piece, thereby removing the opposing piece, provided that a vacant checker square lies behind the confronting playing piece. In the game of checkers all playing pieces are of equal value and move the same number of squares until reaching the opposite side of the playing board.

The game of chess is likewise played on a checkerboard, but involves playing pieces capable of preforming different moves. During the course of the game of chess, a player attempts to remove various of the opponents pieces from the board by moving his own pieces onto spaces occupied by pieces of the opponents. The primary objective is to capture the opponent's King which is achieved by placing the opponent's King in checkmate. As in checkers, the progress of the game is gauged by comparing the number of pieces removed from the board by the two opponents.

A different type of board game requires the participants to each select a single playing piece. This piece is then advanced from location to location around the perimeter of a board, the number of steps in each advance being determined by some means of chance, usually dice. The different locations at which playing pieces might arrive involve various opportunities, rewards or penalties. The progress of the game is usually measured by comparing the relative accumulation of tokens, usually involving monetary facsimiles or property. Variations of this type of game offer participants the opportunity to deviate from the main avenue of progression under prescribed conditions. Although temporary deviations are allowed, the participants must nevertheless return to the main pathway at some point. This particular type of board game involves but a single token, or playing piece for each participant, and the pieces of all participants are advanced along a common path or prescribed alternative paths.

Yet a further type of board game is the type that may be designated generally under the classification of "war" games. Such games may or may not involve playing pieces and board markings bearing indicia of actual armed combat. Nevertheless such games, in one form or another involve a confrontation between "armies," "navies," or "airforces." The object of this type of game is not to reach any particular designation, but instead to move one's pieces and to conduct one's actions so as to fulfill the requirements for removing portions of the opponent's forces. Progress of the game is measured by the relative aggregate strength of each players forces, with the ultimate object being the anihilation of the opponents forces.

The present invention offers an entirely new concept in board game playing piece manipulation. Rather than using a single mobile playing piece during any one move to advance independently or operate upon other inanimate playing pieces, the present invention involves the movement of a selected playing piece in a dynamic fashion to impart motion to other playing pieces. The principal under which motion is imparted is similar to the principal of Newtonian physics which prescribes that for every action there is an equal and opposite reaction. Thus, as with rocket ships and billiard balls a force is used to operate upon one entity, such as a playing piece, to impart movement to adjacent entities. The force employed is not a real force resulting from potential or kenetic energy such as by striking the piece, but rather is an imaginary force attributed to the playing piece sought to be moved. Thus, one playing piece may be attributed a relative force or energy level of "5" while another playing piece may be assigned a higher or lower value, such as "4" or "6." The various playing pieces retain the assigned level of "force" or "pressure" throughout the game, the numerical value of each of which dictates the total impact of moves initiated using that playing piece. However, movement of the various pieces is frequently performed under the control of other playing pieces, and thus, playing pieces are manipulated in accordance with the values assigned to other pieces, rather than the value assigned to the piece actually undergoing motion or progression across the board.

Another way of viewing the movement of the playing pieces of the present invention is in accordance with the principals of momentum or inertia. According to the principal of conservation of momentum, when two or more bodies collide with each other, momentum is conserved. That is, the total momentum before impact equals the total momentum after impact. According to the laws of physics which encompass the property of inertia of matter, matter retains its state of rest or of uniform rectilinear motion so long as it is not acted upon by an external force. However, when an external force is imparted from a mobile playing piece to another otherwise inaminate playing piece, the previously mobile playing piece becomes inanimate upon striking a playing piece located adjacent thereto, which latter piece thence is set in motion. The kinetic energy released by the playing piece imparting the motion is transferred to the piece previously at rest. This is similar in effect to striking one billiard ball with another. Because the billiard balls are of equal mass, a direct impact of one billiard ball against another transfers virtually all of the kinetic energy from the ball initially in motion to a ball initially at rest. The ball previously at rest is set in motion while the ball previously in motion is halted in its movement.

It is to be understood that in connection with the present invention that the concepts of force and pressure are symbolic only and are embodied in intergal numbers assigned to the various playing pieces. The actual physical force with which one playing piece is used to impart motion to another is totally irrelevant to the fundamental concept of the invention. Rather, it is the concept of an idealized force associated with a particular playing piece set in motion that governs the movement of a previously inanimate playing piece located in the path of the playing piece initiating movement.

DESCRIPTION OF THE DRAWINGS

FIG. 1 is a plan view of the game board of the present invention.

FIG. 2 is an enlarged view of a portion of the game board of FIG. 1 showing types of moves that may be effectuated.

FIG. 3 is a different enlarged portion of the game board of FIG. 1 showing other types of moves which may be effectuated.

FIG. 4 is a perspective view of a key man playing piece.

FIG. 5 is a perspective view of a supporting man playing piece.

DESCRIPTION OF THE EMBODIMENT

With reference especially to FIG. 1, a game board 10 is illustrated having a flat surface with a multiplicity of discrete playing piece positions indicated as small squares 11. The squares 11 are arranged to form alternative paths of playing piece movement. These paths form a retilinear grid of rows 12 and columns 13. In addition, diagonal paths of movement are formed between some of the squares 11. The rows 12 do not lie adjacent to each other, but instead are separated by the widths of three squares 11. Similarly the columns 13 are not contiguous, but are likewise separated by a distance of three widths of squares 11. Adjacent columns 13 and rows 12 thereby form the boundary perimeters of the larger squares 14, each of which has nine times the area of a smaller square 11. Within some of the larger squares 14, a central square 15 is positioned. From the corners of the squares 15, diagonal lines 16 extend outward to intersect the adjacent rows 12 and columns 13. A diagonal pathway is thereby defined across some of the larger squares 14.

These diagonal paths form short cuts for playing piece movement between squares 11 positioned at diagonally opposite corners of a larger square 14. For example, and with reference to FIG. 2, a playing piece may be moved from square 11-1 by square 11-9 by taking four steps down the column 13 within which the squares 11-1 through 11-5 are located, and then taking four more lateral steps to progress from square 11-5 to square 11-9 in the row 12-8 within which these latter squares are located. A total of eight playing piece steps would thereby be required to move from diagonally opposite corners of the larger square 14. An alternative path of movement is along a diagonal from square 11-1 past square 15-1 and then to square 11-9. A playing piece can thereby move to the same ultimate destination in two playing piece steps so that the diagonal paths defined within some of the larger squares 14 form short cuts between diagonally opposite ones of the smaller squares 11.

Preferably, the board 10 is formed of a plurality of colors to facilitate movement of the pieces. More specifically, the squares 11 and 15 might be colored a bright orange color. The larger squares 14 within which the smaller squares 15 are located can be yellow in color. The interior portions of the squares 14 not occuppied by the smaller squares 11 or 15 are white.

Two distinctive types of playing pieces are depicted in FIGS. 4 and 5 respectively. The playing piece 17 depicted in FIG. 4 is a key man, or prince and the letter P is inscribed on the disk-like cap 18 which is mounted atop a cylindrical base 19. The supporting man or escort 20 depicted in FIG. 5 does not include a disk-like structure mounted atop its cylindrical form 21, and so is distinguishable from the prince 17 since it lacks a cap 18. A number is inscribed atop the escort 20, such as the number "5" indicated in FIG. 5. This number is associated with the particular escort 20 and corresponds to the units of playing piece movement which piece 20 can initiate along the paths of the rectilinear grid and the diagonal pathways formed on the game board 10. Each player has eight escorts 20, including two each having assigned thereto a move initiating value of three spaces, four spaces, five spaces and six spaces. In addition, each player has a single prince 17. The prince 17 is not assigned a specified number of units of movement, but rather may be moved 1, 2 or 3 spaces during a turn. The eight escorts and the single prince on each team are color coded, so that each player uses only playing pieces of a particular color.

At the start of the game, the playing pieces for each of two players are arranged in the starting positions indicated on the game board 10 in FIG. 1. The prince for one player is numbered 217 with escorts indicated 223, 224, 225 and 226. The prince on the other team is indicated by the number 317 and the escorts are numbered 323, 324, 325 and 326. In playing the game, it is the objective for a player to be the first to land his prince on any one of the squares located in the last row on his opponents side of the board. That is, it is the objective of the player using prince 217 to move his prince to one of the spaces 11 in row 12-1. Conversely, it is the objective of the player using the prince 317 to move his prince to one of the spaces 11 in row 12-9.

As previously indicated, the number on each of the escorts represents the number of spaces that that particular escort must be moved. The escorts 226 and 326 must all be moved six spaces. The escorts 223 and 323 must all be moved three spaces, and so forth. When a player wishes to move his prince, he has the option of moving it one, two or three spaces during each turn. Any one of a player's pieces may be moved during his turn in any direction. A player, however, may not cause any of his playing pieces to retrace steps in the same move.

Fundamental to the present invention is the concept of pressure moves. While the princes 217 and 317 may not be used to initiate pressure moves, any of the escorts may do so. To initiate a pressure move, a player, during his turn, selects an escort and uses that piece to effectuate the pressure move. The selected escort is used to push another playing piece straight backward in the direction in which the selected supporting man is progressing. For example, if the escorts 225 and 326 are initially in the positions indicated in solid lines in FIG. 2, and the player controlling the movement of escort 225 initiates a movement utilizing that playing piece, he must initiate a movement of five spaces, since "5" is the number associated with the particular playing piece 225. To effectuate a pressure move using playing piece 225, that piece is moved the two spaces toward piece 326. Since playing piece 326 at that point obstructs the path of movement of the playing piece 225, the piece 225 is halted in its movement and the balance of the value number 5 associated with that piece over the two spaces therefore moved is imparted to the playing piece 326. That is, playing piece 225 is halted in the position indicated in dotted lines as 225', and playing piece 326 is forced backward the remaining three spaces allocated to playing piece 225. At the termination of the move of playing piece 225, playing piece 326 will be in the position indicated in dotted lines and designated as 326' in FIG. 2.

It should be bourne in mind that when selected for movement, an escort must always be moved the same number of spaces as are imprinted on that piece except that in the case of a pressure move, all or part of the escort's move is transferred to an adjacent playing piece, so that the piece to which the remainder of the move is transferred finishes the turn. Thus, a move may consist of both free steps, which are those steps taken by an escort before reaching a blocking playing piece, and pressured steps, which are those steps which the blocking or confronting playing piece is forced to take. The sum of free steps and pressured steps for any move must add up to the number of steps labeled on the pushing escort.

If an escort initiating a move is already positioned in a square 11 adjacent to another man, the selected playing piece for initiating movement does not have to be physically moved at all in order to transfer its pressure to the adjacent piece. In this case, the adjacent piece is moved backward the entire number of spaces 11 to which the selected piece is entitled to move, once the player effectuating the move explains to his opponent what he is doing. For example, if playing piece 326 is initially in the position inidcated in solid lines in FIG. 2 and a piece 223 is initially at space 225', piece 223 can be used to initiate a pressure move in which it remains stationary and playing piece 326' is forced back to space 326'.

Another important characteristic of the game board 10 is a construction which allows a player to change the direction of movement before applying pressure. For example, with reference to FIG. 3, if the player controlling the movement of playing piece 326 wishes to force the opponents playing piece 224 in the direction indicated by the arrow 24, he can do so only by changing the direction of movement of the playing piece 326. From the position of FIG. 3, the playing piece 326 could pressure playing piece 224 backwards six steps to square 11-20 in the direction opposite the arrow 24. However, if the player wishes to force the playing piece 224 in the direction of arrow 24, he can do so by moving playing piece 326 first diagonally to square 15-2 and then square 11-17, changing movement twice in the process. From square 11-17 playing piece 326 is moved two more of its total of six spaces to square 11-19. Here the playing piece 326 stops moving, and transfers its remaining two spaces of movement to playing piece 224 which is then forced two spaces in the direction indicated by the arrow at 24 and finishes the turn resting on space 11-26. It can be seen that an escort may change direction once or several times before applying pressure to a different playing piece, but once another playing piece is under pressure, it must always be pushed straight back in the direction from which it was pressured.

Since escorts may be used to apply pressure, they are used to push back the opponent's prince in order to prevent him from moving forward and reaching the opposite side of the game board 10. The escorts are also used to push the opponents escorts out of the way and to interfere with the opponents escorts in their attempts to pressure their own prince toward the opposite side of the board. By strategically blocking the movement of the opponents pieces, the opponent is forced to either take another route, or waste a move pushing the obstructing piece back, thus slowing down his own forward movement.

Sometimes during a pressure move it is not possible to pressure a playing piece back along a straight line because the edge of the board is reached or because there is no corresponding diagonal path of travel. In this case, pressured steps must follow the straightest path possible which takes the pressured piece furthest from the playing piece applying the pressure. For example, with reference to FIG. 2, if a selected escort is positioned at square 15-1 and acts to exert the pressure of its move on a piece positioned at square 11-5, the playing piece positioned at square 11-5 cannot be forced directly backward, since there is no continuation of the diagonal pathway in all instances. Instead, the pressure is diverted to force the piece from square 11-5 back to square 11-21, toward square 11-22 and in the direction of arrow 25 until the requisite number of spaces have been moved.

If a selected supporting piece is positioned at square 11-15 and acts to exert pressure on another piece positioned at square 11-16, the piece positioned at square 11-16 can be moved either in the direction of arrow 27, or in the direction opposite arrow 27. In this situation the moving player has a choice of two directions in which to pressure a playing piece.

Compound pressure moves are also possible in which the selected escort is used to initiate a pressure move to act on one piece, which in turn exerts pressure to a subsequent playing piece. With reference to FIG. 3, for example, if the playing piece 324 initiates a pressure move in the direction indicated by the arrow 26 from its position indicated in solid lines, the piece 324 is moved to square 11-23. At this point, the piece 324 ceases movement and the balance of three space moves are transferred to the playing piece 325. However, the playing piece 325 can advance only one space before it is confronted by playing piece 224. Playing piece 325 thereby ceases movement at square 11-25 and transfers the remaining two space moves to playing piece 224, which is then pressured in the direction of arrow 26 to space 11-24. A player may thereby use his escorts to pressure any possible number of his own playing pieces, his opponents playing piece or any combination of both. Only escorts may initiate pressure, however. They may pressure any playing piece on the board including princes 17. Princes 17 may not be used to initiate a pressure move, but may take part in a pressure move orginated by an escort 20.

To play the game, the player to make the first move is selected. This may be done by flipping a coin. The first player then proceeds to move one of his playing pieces with the purpose of eventually moving his prince 17 into his opponents back row, 12-1 or 12-9 of squares 11. During a turn, a player may move one of his escorts or his prince. He may pressure his prince with one of his escorts to advance it ahead more quickly. He may pressure his other escorts and pressure his components prince or escorts in order to push back their advance, or he may use may combination of the foregoing to reach his objective. The prince may move one, two or three spaces in any direction, but they may not initiate pressure moves. The playing pieces may not pass through or jump over other playing pieces. They must either go around or apply pressure. As previously indicated, an escort may change direction before applying pressure, but once the supporting man is next to the playing piece to be pressured, that piece must be pushed back in a straight line in the direction from which the supporting man arrived. If the playing piece initiating the pressure move is intially in a position directly adjacent to the playing piece to be pressured, pressure is exerted along a straight line passing through both the pressure initiating and pressure receiving pieces in a vector emanating from the pressure initiating piece. If a plurality of playing pieces are on adjacent squares in a path of pressure, pressure is passed from the first to the last man in the line, with all physical movement being performed by the last man. For example, with reference to FIG. 2 if playing pieces occupy the positions 11-9, 11-10 and 11-11, and the playing piece at square 11-9 initiates movement in the direction indicated by the arrow 28, the playing pieces on the squares 11-9 and 11-10 will both pass the pressure of the move to the playing piece on square 11-11, which in turn will be moved to square 11-12, 11-13 and so forth in the direction of the arrow 28 for the entire value of the move.

While but a single set of rules has been explained in connection with the deployment of the playing pieces and the game board depicted, it is to be understood that numerous variations may be introduced into the rules of the game. The invention is not limited to a game employing any particular set of rules, but instead is directed to the concept of a board game employing a fixed number of pieces which remain on the game during the entire game, and which may be used at various times to transmit pressure of movement to a predetermined degree designated for each playing piece to other playing pieces situated on adjacent positions. Accordingly, the present invention is not restricted to the embodiment depicted herein, but instead is defined in the claims appended hereto.

I claim:

1. A game comprising a playing board having a flat surface with a multiplicity of discrete playing piece positions thereon arranged in a plurality of rows and a plurality of columns of distinctive colored playing piece positions which intersect to form a plurality of adjacent closed geometric figures, said figures enclosing portions of said board colored other than with said distinctive color, and certain of said playing piece positions at the intersections of said rows and columns have diagonal indicia leading therefrom, there being at least one playing piece position on each of said diagonal indicia, said distinctive colored playing piece positions thereby defining a grid of alternative rectilinear paths and diagonal paths of playing piece movement, at least some of said rectilinear paths having a different number of playing piece positions than said diagonal paths whereby strategy may be employed in alternatively selecting a path amongst said rectilinear and diagonal paths, a plurality of playing pieces for each of a plural number of players, and indicia means associated with each of said playing pieces specifying an exact value number of units of movement which a piece may cause by progression along said paths and by transfer to an adjacent confronting piece in a direction determined by the alignment of said movement causing piece and said confronting piece whereby ones of said playing pieces are adapted for movement by each player in rotation in said paths according to the value number associated with a selected piece which is moved until confronted with another playing piece blocking the path of movement of said selected piece so that the excess of the balance of said value number associated with said selected playing piece over the number of units theretofore moved by said selected playing piece in the current turn in reaching said confronting playing piece is imparted to said confronting playing piece to move the confronting playing piece in a direction of alignment of said selected piece and said confronting piece in lieu of said selected piece, a number of positions equal to the aforesaid balance.

2. Apparatus according to claim 1 characterized in that said distinctive colored playing piece positions are of square shape and at least some are arranged in adjacent fashion to form a rectilinear grid of alternative paths.

3. Apparatus according to claim 2 further characterized in that at least some of said distinctive colored playing piece positions are positioned at intermediate locations in at least some of said diagonal paths of movement between said intersections in said rectilinear grid.

4. Apparatus according to claim 3 further characterized in that said diagonal paths between adjacent rows and columns include a fewer number of distinctive colored playing piece positions than alternative rectilinear paths between the same rows and columns whereby said diagonal paths form short cuts between ones of said playing piece positions in said rectilinear grid.

5. The apparatus according to claim 1 further characterized in that the value numbers are marked on the associated playing pieces.

6. The apparatus according to claim 1 further comprising key playing pieces which are selected for movement an alternative number of positions.

7. The apparatus according to claim 6 further characterized in that said key playing pieces are of a distinct shape from the remainder of said playing pieces.

* * * * *